US007416289B2

(12) United States Patent
Katsuyama

(10) Patent No.: US 7,416,289 B2
(45) Date of Patent: Aug. 26, 2008

(54) INK CARTRIDGE AND INKJET RECORDING APPARATUS EQUIPPED WITH THE INK CARTRIDGE

(75) Inventor: Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 370 days.

(21) Appl. No.: 11/265,420

(22) Filed: Nov. 2, 2005

(65) Prior Publication Data

US 2006/0098061 A1 May 11, 2006

(30) Foreign Application Priority Data

Nov. 10, 2004 (JP) ..... 2004-326279

(51) Int. Cl.
*B41J 2/175* (2006.01)

(52) U.S. Cl. ..... 347/86; 347/87

(58) Field of Classification Search ..... 347/85, 347/86, 87; 222/92, 100, 107, 562
See application file for complete search history.

(56) References Cited

U.S. PATENT DOCUMENTS 5,307,091 A * 4/1994 DeCoste, Jr. ..... 347/86
5,699,936 A * 12/1997 Sakamoto ..... 222/107
6,053,606 A * 4/2000 Yamaguchi et al. ..... 347/86
6,241,132 B1 * 6/2001 Morrison ..... 222/541.6
6,609,789 B1 * 8/2003 Hunt ..... 347/86
7,287,843 B2 * 10/2007 Muranaka et al. ..... 347/86

FOREIGN PATENT DOCUMENTS

JP 2002-120382 4/2002
JP 2003-305863 10/2003
JP 2004-50823 2/2004

OTHER PUBLICATIONS

Jul. 20, 2007 Chinese official action (with English translation) in connection with Chinese patent application No. 2005101202872.

* cited by examiner

*Primary Examiner*—Anh T. N. Vo
(74) *Attorney, Agent, or Firm*—Cooper & Dunham, LLP

(57) ABSTRACT

An ink cartridge is disclosed. The ink cartridge comprises an ink refill bag, and an ink refill bag housing in which the ink refill bag is accommodated. The ink refill bag includes a cap having an ink passage through which ink is supplied to an inkjet recording apparatus that ejects ink droplets for printing, and an ink storing section formed in a bag-like shape by thermally welding plural flexible film members together. The ink refill bag housing is provided with at least one bag loading opening through which the ink refill bag is loaded and removed.

10 Claims, 4 Drawing Sheets

INK CARTRIDGE AND INKJET RECORDING APPARATUS EQUIPPED WITH THE INK CARTRIDGE

BACKGROUND

1. Technical Field

This disclosure relates to an ink cartridge for supplying ink to a recording head of an inkjet recording apparatus, an inkjet printer, or the like, and an inkjet recording apparatus equipped with the ink cartridge.

2. Description of the Related Art

There have been liquid ejectors for use as inkjet recording apparatuses and inkjet printers that print on paper and the like by ejecting ink droplets. A typical inkjet printer is equipped with a replaceable ink cartridge. In most cases, once the ink cartridge becomes empty, a new ink cartridge filled with ink is loaded to replace the empty ink cartridge. The empty ink cartridge is not reused, which is not cost effective. In view of that, Patent Document 1 discloses an ink cartridge including a housing that is rigid enough to protect an ink bag, which is filled with ink, accommodated therein for protection from impact during delivery. This ink cartridge is designed to allow replacement of the ink bag. Patent Document 2 discloses an ink cartridge having a refill port through which ink is resupplied.

[Patent Document 1] Japanese Patent Laid-Open Publication No. 2004-50823

[Patent Document 2] Japanese Patent Laid-Open Publication No. 2003-305863

The ink cartridges disclosed in Patent Documents 1 and 2, however, have various drawbacks and have not come into wide use.

For example, according to Patent Document 1, the housing of the ink cartridge, which is formed with the use of screws or bonding, is disassembled for replacing the ink cartridge accommodated in the housing. The ink cartridge disclosed in Patent Document 2 is disadvantageous in that refilling with ink is time-consuming and may cause contamination. The newly supplied ink is mixed with the ink remaining in the cartridge, resulting in lowering the ink quality.

BRIEF SUMMARY

According to one aspect of the present invention, there is provided an ink cartridge whose housing and ink refill bag cap are improved in shape so as to allow replacement of an ink refill bag without disassembling the housing and, therefore, facilitate the replacement of the bag and the maintenance of the ink cartridge.

According to another aspect of the present invention, there is provided an inkjet recording apparatus equipped with the aforesaid ink cartridge.

There is provided in a further aspect of the present invention an ink cartridge comprising an ink refill bag that includes a cap having an ink passage through which ink is supplied to an inkjet recording apparatus that ejects ink droplets for printing, and an ink storing section formed by thermally welding plural flexible film members together; and an ink refill bag housing in which the ink refill bag is accommodated; wherein the ink refill bag housing is provided with at least one bag loading opening through which the ink refill bag is loaded and removed.

DETAILED DESCRIPTION OF THE PREFERRED EMBODIMENT

In a preferred embodiment of the present invention, an ink cartridge comprises an ink refill bag and an ink refill bag housing in which the ink refill bag is accommodated. The ink refill bag comprises a cap having an ink passage through which ink is supplied to an inkjet recording apparatus that prints on paper and the like by ejecting ink droplets, and an ink storing section formed in a bag-like shape by thermally welding plural flexible film members together. The ink refill bag housing is provided with at least one bag loading opening through which the ink refill bag is loaded and removed.

The following description provides an exemplary embodiment of the present invention with reference to accompanying drawings. While the present invention is described in terms of preferred embodiments, it should be understood that the invention is not limited thereto.

Embodiment

Figure 1:
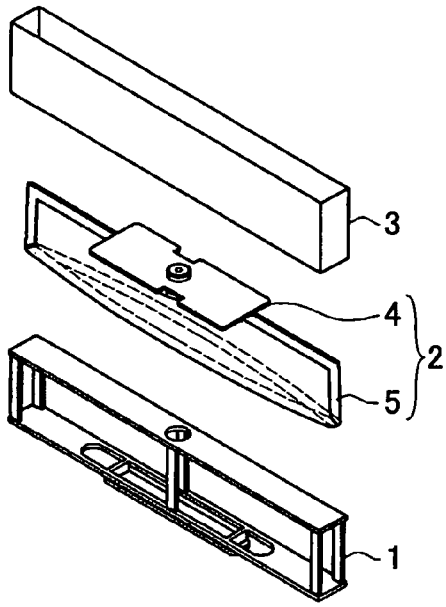
FIG. 1 is an exploded perspective view showing an ink cartridge according to an embodiment of the present invention.

An ink cartridge 100 of this embodiment has the following configuration. FIG. 1 is an exploded perspective view showing the ink cartridge 100 according to this embodiment. With reference to FIG. 1, the ink cartridge 100 of this embodiment comprises an ink refill bag housing 1, an ink refill bag 2, and a label 3. The ink refill bag housing 1 is an integrally molded frame in the shape of a rectangular parallelepiped. The ink refill bag 2 comprises a cap 4 having an ink passage 23 through which ink is supplied to an inkjet recording apparatus, and an ink storing section 5 formed by thermally welding plural flexible film members 6-8 (described below). The label 3 is an elongated sheet with its ends connected together to form a loop.

Figure 3A:
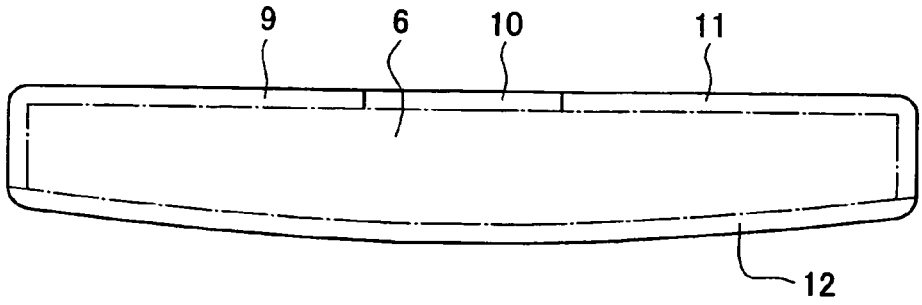
FIG. 3A illustrates a first flexible film member of an ink storing section of an ink refill bag according to an embodiment of the present invention.
Figure 3B:
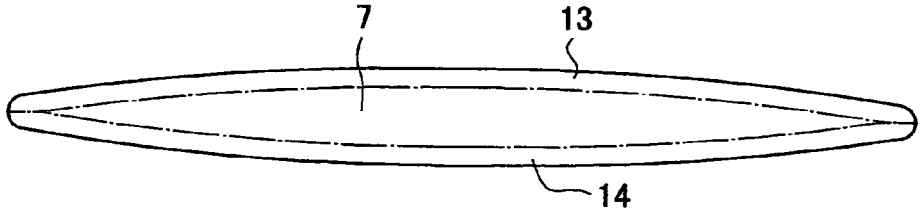
FIG. 3B illustrates a second flexible film member of the ink storing section of the ink refill bag according to an embodiment of the present invention.
Figure 3C:
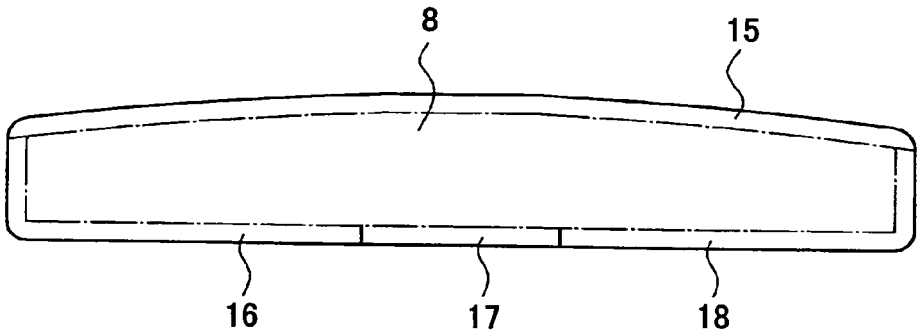
FIG. 3C illustrates a third flexible film member of the ink storing section of the ink refill bag according to an embodiment of the present invention.
Figure 3D:
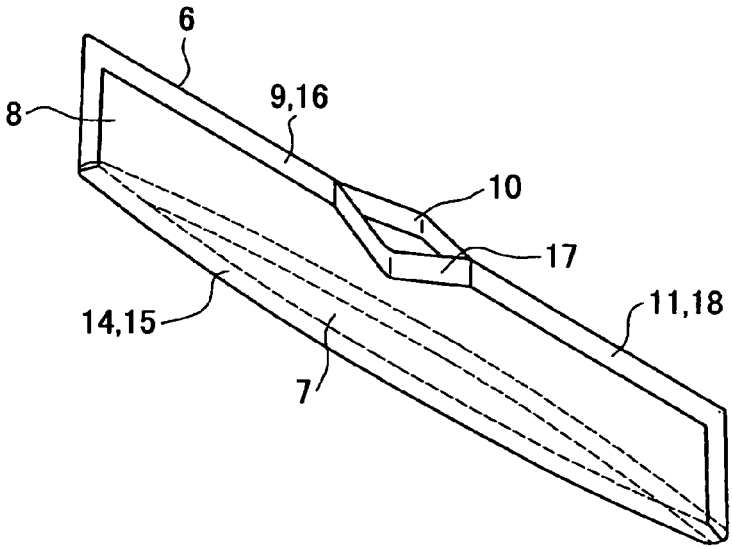
FIG. 3D illustrates a perspective view of a bag-shaped ink storing section formed with the first through third flexible film members according to an embodiment of the present invention.

The following describes the ink refill bag 2 in greater detail with reference to the accompanying drawings. FIG. 3A illustrates the first flexible film member 6 of the ink refill bag 2 of this embodiment. FIG. 3B illustrates the second flexible film member 7 of the ink refill bag 2 of this embodiment. FIG. 3C illustrates the third flexible film member 8 of the ink refill bag 2 of this embodiment. FIG. 3D illustrates a perspective view of the ink storing section 5 shaped like a bag, which is formed with the first through third flexible film members 6-8 according to this embodiment.

The ink storing section 5 of the ink refill bag 2 shown in FIG. 3D is formed with the first through third flexible film members 6-8 thermally welded together at peripheral edges thereof. More specifically, a peripheral edge 9 of the flexible film member 6 of FIG. 3A is welded to a peripheral edge 16 of the flexible film member 8 of FIG. 3C. A peripheral edge 11 of the flexible film member 6 of FIG. 3A is welded to a peripheral edge 18 of the flexible film member 8 of FIG. 3C. A peripheral edge 12 of the flexible film member 6 of FIG. 3A is welded to a peripheral edge 13 of the flexible film member 7 of FIG. 3B. A peripheral edge 14 of the flexible film member 7 of FIG. 3B is welded to a peripheral edge 15 of the flexible film member 8 of FIG. 3C.

As shown in FIG. 3D, a peripheral edge 10 of the flexible film member 6 of FIG. 3A and a peripheral edge 17 of the flexible film member 8 of FIG. 3C are not welded together. As described below in greater detail, a weld portion 25 forming a lower end of the cap 4 of FIG. 1 is inserted in a clearance formed between the peripheral edge 10 and the peripheral edge 17. Then, the peripheral edges 10 and 17 are thermally welded to the weld portion 25 of the cap 4, and thus the ink refill bag 2 is completed.

Figure 4A:
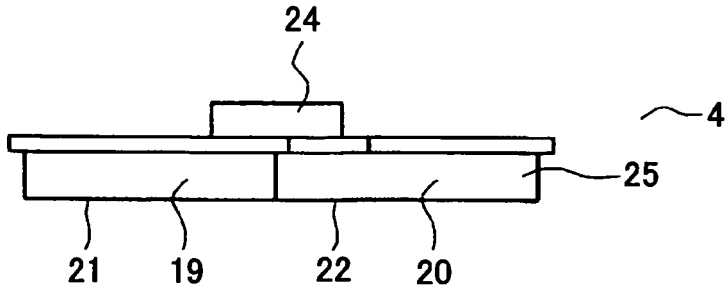
FIG. 4A is a front view showing a cap of an ink refill bag according to an embodiment of the present invention.
Figure 4B:
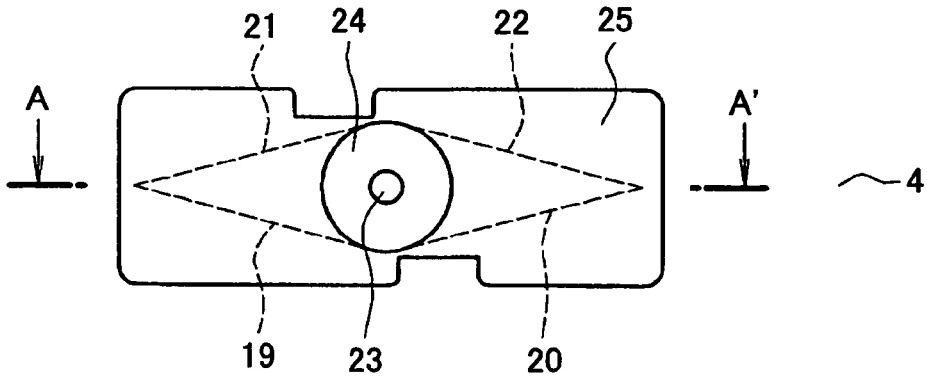
FIG. 4B is a plan view showing the cap of the ink refill bag according to an embodiment of the present invention.
Figure 4C:
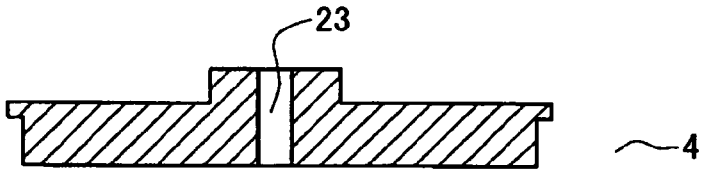
FIG. 4C is a cross-sectional view showing the cap of the ink refill bag as taken along line A-A' of FIG. 4B.
Figure 4D:
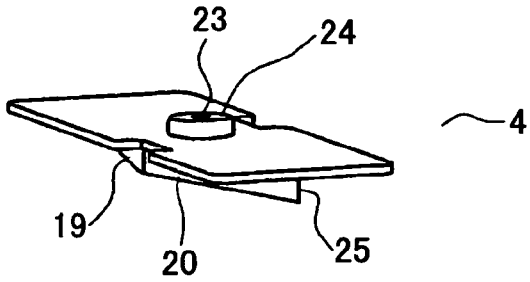
FIG. 4D is a perspective view showing the cap of the ink refill bag according to an embodiment of the present invention.

FIG. 4A-4D illustrate the cap 4 to be inserted into the clearance formed between the peripheral edge 10 of the flexible film member 6 and the peripheral edge 17 of the flexible film member 8 so as to be thermally welded to the peripheral edge 10 and the peripheral edge 17. FIG. 4A is a front view showing the cap 4 of the ink refill bag 2 according to this embodiment. FIG. 4B is a plan view showing the cap 4 of the ink refill bag 2 according to this embodiment. FIG. 4C is a cross-sectional view showing the cap 4 of the ink refill bag 2 as taken along line A-A' of FIG. 4B. FIG. 4D is a perspective view showing the cap 4 of the ink refill bag 2 according to this embodiment.

With reference to FIG. 4A-4D, the cap 4 of the ink refill bag 2 includes the ink passage 23 defined by a cylindrical clearance through which ink is supplied to the inkjet recording apparatus. A press-fit section 24 having a cylindrical shape and forming an upper end of the cap 4 is press-fitted in a cap fitting opening 26 (described later) formed on the ink refill bag housing 1 such that the ink refill bag 2 is fixed to the ink refill bag housing 1.

The peripheral edge 10 (of the flexible film member) of the ink storing section 5 is thermally welded to side faces 21 and 22 (FIGS. 4A and 4B) of the weld portion 25 forming the lower end of the cap 4, while the peripheral edge 17 (of the flexible film member 8) of the ink storing section 5 is thermally welded to side faces 19 and 20 (FIGS. 4A, 4B, and 4D) of the weld portion 25. As described above, the ink refill bag 2 is formed by thermally welding the three flexible film members 6-8 together and connecting the cap 4 to the ink storing section 5.

Figure 5A:
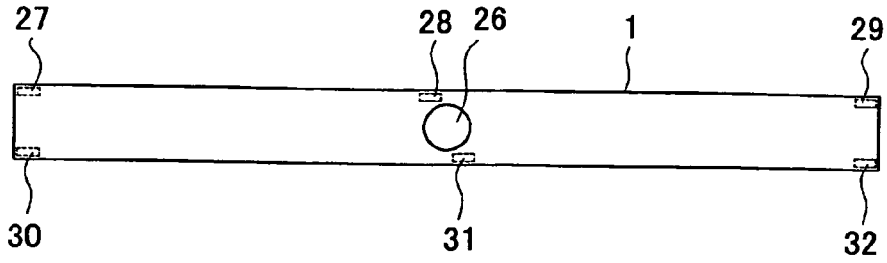
FIG. 5A is a plan view showing an ink refill bag housing according to an embodiment of the present invention.
Figure 5B:
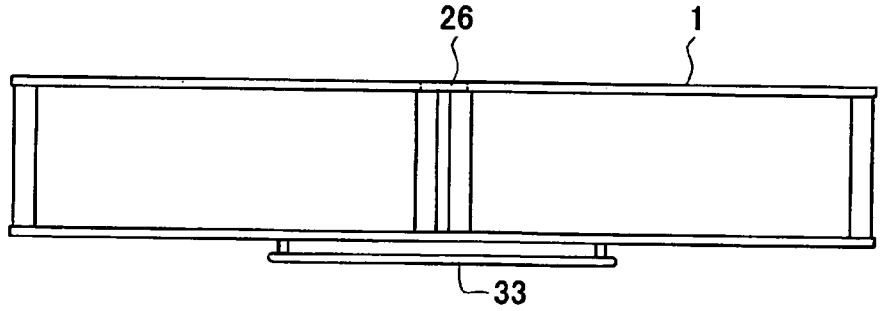
FIG. 5B is a front view showing the ink refill bag housing according to an embodiment of the present invention.
Figure 5C:
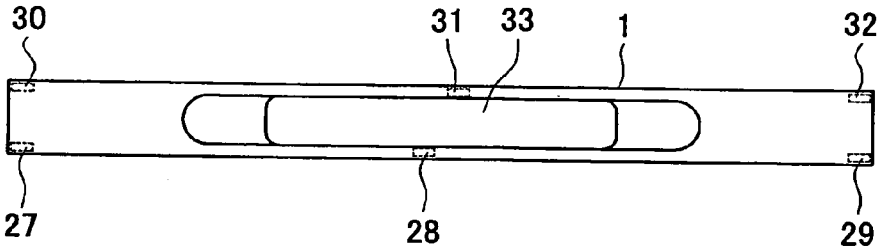
FIG. 5C is a bottom view showing the ink refill bag housing according to an embodiment of the present invention.
Figure 5D:
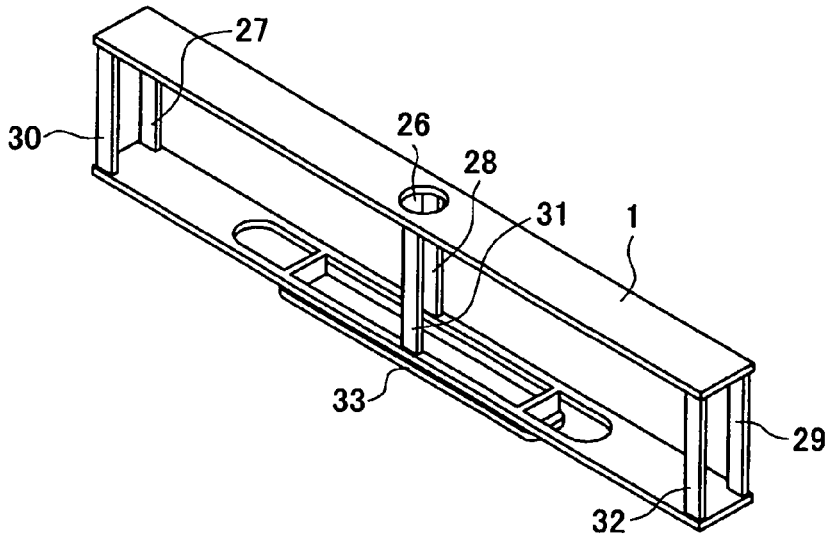
FIG. 5D is a perspective view showing the ink refill bag housing according to an embodiment of the present invention.

The following provides a detailed description of the ink refill bag housing 1 with reference to the accompanying drawings. FIG. 5A is a plan view showing the ink refill bag housing 1 according to this embodiment. FIG. 5B is a front view showing the ink refill bag housing 1 according to this embodiment. FIG. 5C is a bottom view showing the ink refill bag housing 1 according to this embodiment. FIG. 5D is a perspective view showing the ink refill bag housing 1 according to this embodiment of the present invention.

With reference to FIGS. 5A-5D, the ink refill bag housing 1 of this embodiment is a frame in the shape of a rectangular parallelepiped, comprising a housing upper face and a housing lower face each having a generally rectangular shape, and connecting sections 27-32 for connecting the housing upper face to the housing lower face. As shown in FIGS. 5A and 5D, the cap fitting opening 26, in which the press-fit section 24 of the cap is press-fitted, is formed in the housing upper face. In an embodiment of the present invention, as shown in FIG. 5D, six columnar connecting sections 27-32 connect a center portion and opposing end portions of each of two longitudinal edges of the upper face to a corresponding center portion and corresponding opposing end portions of each of two corresponding longitudinal edges of the lower face. As shown in FIGS. 5C and 5D, an ink cartridge attachment section 33, at which the ink cartridge 100 of this embodiment is attached to the inkjet recording apparatus, is formed on the housing lower face.

According to the illustrated embodiment, the ink refill bag housing 1 of the ink cartridge 100 is a frame in the shape of a rectangular parallelepiped. Therefore, the ink refill bag 2 can be loaded into the housing 1 through one of openings, each defined by the upper and lower faces of the housing 1 and two of the adjacent connecting sections 27-32. Then, the press-fit section 24 forming the upper end of the cap 4 of the ink refill bag 2 is press-fitted into the cap fitting opening 26 of the housing 1. In this way, the ink refill bag 2 can be fixed to the ink refill bag housing 1 without disassembling the housing 1.

The ink refill bag 2 fixed to the ink refill bag housing 1 can also be removed from the housing 1 without disassembling the housing 1. While the ink refill bag housing 1 is an integrally molded frame in the illustrated embodiment, the housing 1 may be formed with separately molded component parts. Although the housing 1 is not limited to a frame, the housing 1 is provided with at least one bag loading opening through which the ink refill bag 2 is loaded and removed without disassembling the housing 1.

Figure 2:
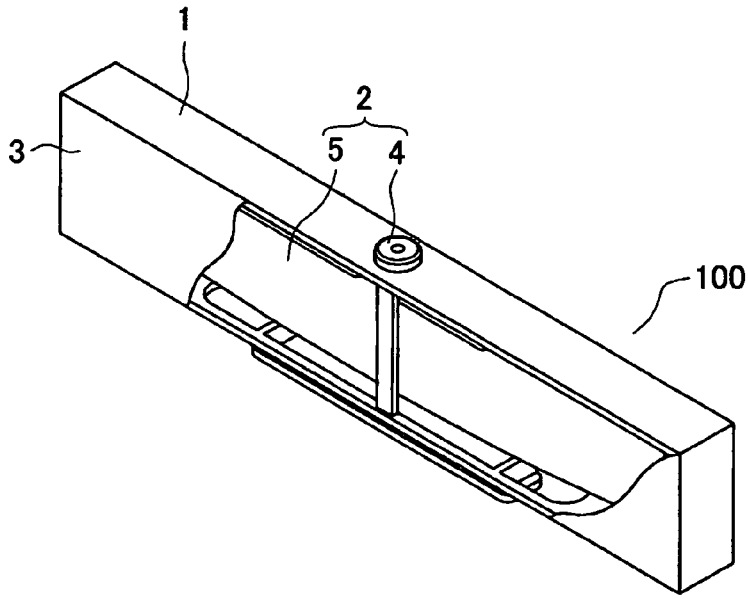
FIG. 2 is a perspective view showing an ink cartridge according to an embodiment of the present invention.

FIG. 2 is a perspective view showing the ink cartridge 100 according to the above embodiment. As shown in FIG. 2, the ink refill bag 2 is accommodated inside the ink refill bag housing 1. The label 3 formed with an elongated sheet is disposed to surround the housing 1 across the connecting sections 27-32 (FIGS. 5A-5D) of the ink refill bag housing 1, and the opposing ends of the sheet are connected together. While the label 3 is attached to the ink refill bag housing 1 in this embodiment, the label 3 is not necessarily required if the elimination of the label 3 does not affect the usability of the ink cartridge 100.

The ink cartridge 100 of the above illustrated embodiment allows replacement of the ink refill bag 2 without disassembling the ink refill bag housing 1. Moreover, the ink refill bag 2 can be easily loaded and removed since the press-fit section 24 that has a cylindrical shape and forms the upper end of the cap 4 of the ink refill bag 2 of the ink cartridge 100 and the cap fitting opening 26 that is formed in the upper face of the ink refill bag housing 1 for fixing the bag 2 to the ink refill bag housing 1 are provided. It is therefore possible for users to replace the ink refill bags 2 easily.

The present application is based on Japanese Priority Application No. 2004-326279 filed on Nov. 10, 2004, with the Japanese Patent Office, the entire contents of which are hereby incorporated by reference.

What is claimed is:

1. An ink cartridge comprising:

an ink refill bag including a cap having an ink passage through which ink is supplied to an inkjet recording apparatus that ejects ink droplets for printing; and an ink storing section formed by thermally welding a plurality of flexible film members together; and an ink refill bag housing in which the ink refill bag is accommodated;

wherein the ink refill bag housing is provided with at least one bag loading opening through which the ink refill bag is loaded and removed, and wherein the ink refill bag housing is a generally rectangular parallelepiped frame including a generally rectangular upper face having an attachment section to be detachably attached to the inkjet recording apparatus;

a generally rectangular lower face having a cap fitting opening at a substantial center in which the cap of the ink refill bag is press-fitted; and six columnar connecting sections that connect a center portion and opposing end portions of each of two longitudinal edges of the upper face to a corresponding center portion and corresponding opposing end portions of each of two corresponding longitudinal edges of the lower face.

2. The ink cartridge as claimed in claim 1, wherein the ink refill bag is fixed to the ink refill bag housing by press-fitting a press-fit section having a cylindrical shape and forming an upper end of the cap into the cap fitting opening.

3. The ink cartridge as claimed in claim 1, wherein the ink refill bag is formed by the steps of:

thermally welding a first peripheral edge, and second and third peripheral edges, which are adjacent to the first peripheral edge, of a generally-rectangular first flexible film member of the flexible film members to corresponding first, second, and third peripheral edges of a generally-rectangular second flexible film member of the flexible film members, except at center portions of the first peripheral edges of the first and second flexible members;

thermally welding fourth peripheral edges of the first and second flexible film members opposing the respective first peripheral edges to two mutually-opposing peripheral edges of a third flexible film member, respectively; and thermally welding the center portions of the first and second flexible film members to a side surface of a weld portion forming a lower end of the cap.

4. The ink cartridge as claimed in claim 1, further comprising:

a label formed with an elongated sheet that is disposed to surround the ink refill bag housing across the six connecting sections except on the upper and lower faces of the housing and is connected at opposing ends to form a loop.

5. An inkjet recording apparatus comprising:

an ink cartridge that comprises an ink refill bag including a cap having an ink passage through which ink is supplied to an inkjet recording apparatus that ejects ink droplets for printing; and an ink storing section formed in a bag-like shape by thermally welding a plurality of flexible film members together; and an ink refill bag housing in which the ink refill bag is accommodated;

wherein the ink refill bag housing is provided with at least one bag loading opening through which the ink refill bag is loaded and removed, and wherein the ink refill bag housing is a generally rectangular parallelepiped frame including a generally rectangular upper face having an attachment section to be detachably attached to the inkjet recording apparatus, a generally rectangular lower face having a cap fitting opening at the substantial center in which the cap of the ink refill bag is press-fitted, and six columnar connecting sections that connect a center portion and opposing end portions of each of two longitudinal edges of the upper face to a corresponding center portion and corresponding opposing end portions of each of two corresponding longitudinal edges of the lower face.

6. The inkjet recording apparatus as claimed in claim 5, wherein the ink refill bag is fixed to the ink refill bag housing by press-fitting a press-fit section having a cylindrical shape and forming an upper end of the cap into the cap fitting opening.

7. The inkjet recording apparatus as claimed in claim 5, further comprising:

a label formed with an elongated sheet that is disposed to surround the ink refill bag housing across the six connecting sections except on the upper and lower faces of the housing and is connected at opposing ends to form a loop.

8. An ink cartridge comprising:

an ink refill bag including a cap having an ink passage through which ink is supplied to an inkjet recording apparatus that ejects ink droplets for printing, and an ink storing section; and an ink refill bag housing in which the ink refill bag is accommodated, wherein the ink refill bag housing is provided with at least one bag loading opening through which the ink refill bag is loaded and removed, and wherein the ink refill bag housing is a generally rectangular parallelepiped frame including a generally rectangular upper face having an attachment section to be detachably attached to the inkjet recording apparatus, a generally rectangular lower face having a cap fitting opening at the substantial center in which the cap of the ink refill bag is press-fitted, and a plurality of columnar connecting sections for connecting the upper to the lower face.

9. The ink cartridge as claimed in claim 8, wherein the ink refill bag is fixed to the ink refill bag housing by press-fitting a press-fit section having a cylindrical shape and forming an upper end of the cap into the cap fitting opening.

10. The ink cartridge as claimed in claim 8, further comprising:

a label formed with an elongated sheet that is disposed to surround the ink refill bag housing across the six connecting sections except on the upper and lower faces of the housing and is connected at opposing ends to form a loop.

* * * * *